US005316494A

United States Patent [19]

Flanagan et al.

[11] Patent Number: 5,316,494

[45] Date of Patent: May 31, 1994

[54] SNAP ON PLUG CONNECTOR FOR A UHF CONNECTOR

[75] Inventors: James R. Flanagan, Harrisburg; Michael S. Garland, Columbia, both of Pa.

[73] Assignee: The Whitaker Corporation, Wilmington, Del.

[21] Appl. No.: 908,699

[22] Filed: Aug. 5, 1992

[51] Int. Cl.[5] ..... H01R 13/627

[52] U.S. Cl. ..... 439/352; 439/578

[58] Field of Search ..... 439/352, 578–585, 439/586, 587, 394, 675, 891

[56] References Cited

U.S. PATENT DOCUMENTS

| | | | |
|---|---|---|---|
| 3,297,979 | 1/1967 | O'Keefe et al. | 339/177 |
| 3,372,364 | 3/1968 | O'Keefe et al. | 339/177 |
| 3,445,794 | 5/1969 | O'Keefe et al. | 333/97 |
| 3,745,514 | 7/1973 | Brishka | 439/352 |
| 4,017,139 | 4/1977 | Nelson | 439/352 |
| 4,047,788 | 9/1977 | Forney, Jr. et al. | 339/177 R |
| 4,096,627 | 6/1978 | Forney, Jr. et al. | 29/628 |
| 4,374,606 | 2/1983 | Lathrop | 399/177 R |
| 4,697,859 | 10/1987 | Fisher, Jr. | 439/246 |
| 4,812,129 | 3/1989 | Rofer et al. | 439/891 |
| 5,127,853 | 7/1992 | McMills et al. | 439/578 |
| 5,181,861 | 1/1993 | Gaver, Jr. et al. | 439/578 |

*Primary Examiner*—Larry I. Schwartz
*Assistant Examiner*—Hien D. Vu
*Attorney, Agent, or Firm*—Gerald K. Kita

[57] ABSTRACT

An electrical plug (1) for connection to a jack (2), comprises, a plug portion (3) of termination of a coaxial cable, a coupling ring (4), a grip member (6) moveable over the coupling ring (4) and adapted to snap over a catch (8) at a forward end of the coupling ring (4), a portion of the coupling ring (4) being inwardly deflectable by the grip member (6), and a portion (10) on the coupling ring (4) that locks against the external diameter of the jack (2).

12 Claims, 5 Drawing Sheets

SNAP ON PLUG CONNECTOR FOR A UHF CONNECTOR

FIELD OF THE INVENTION

The invention relates to an electrical connector for termination to a coaxial cable and for connection to a threaded connector.

BACKGROUND OF THE INVENTION

Externally threaded connectors, such as UHF jacks, are known in the art. A coaxial cable is terminated with a UHF plug having a threaded coupling ring for connection to the jack.

In an assembly line of a factory, a turning motion to effect threading the coupling ring onto the jack is time consuming. A threaded connection can be rotated excessively without a positive feel or a torque limiting feature that occurs when the connection of the plug and jack are secure. A need has arisen for an electrical plug that can be connected securely with an externally threaded UHF connector without a need for a turning motion for causing the plug to turn onto the threads of the UHF connector. A further requirement of the factory environment is for an electrical plug that has a positive feel to indicate a secure connection to a threaded connector.

Connectors that are mated with a push on movement include, a connector disclosed in U.S. Pat. No. 4,374,606, wherein, spring fingers on an electrical connector encircle and radially grip a mating connector. An electrical connector according to U.S. Pat. No. 4,697,859, includes a cup shaped front end for encircling a mating electrical connector.

SUMMARY OF THE INVENTION

According to the invention, an electrical plug is adapted for connection to a threaded jack connector with a positive feel that a secure connection has been made.

Further according to the invention, an electrical plug is adapted for connection to a threaded jack connector with a push on motion instead of a turning motion.

The invention resides in an electrical plug for connection to a coupling, and comprises, a plug portion for termination of a coaxial cable, a coupling ring, a grip moveable over the coupling ring and adapted to snap over a detent at a forward end of the coupling ring, and a portion on the coupling ring that locks against the external diameter of the threaded coupling upon the coupling ring being deflected inwardly by the grip.

DESCRIPTION OF THE DRAWINGS

The invention will now be described by way of example, with reference to the accompanying drawings, according to which.

DETAILED DESCRIPTION

With reference to the Figures, two embodiments of an electrical plug 1 are disclosed. The following description applies to each of the two embodiments. The electrical plug 1 is adapted for connection to a threaded jack 2, with a positive feel that a secure connection has been made. The plug 1 is adapted for connection to the threaded jack 2 with a push on motion instead of a turning motion.

Figure 3:
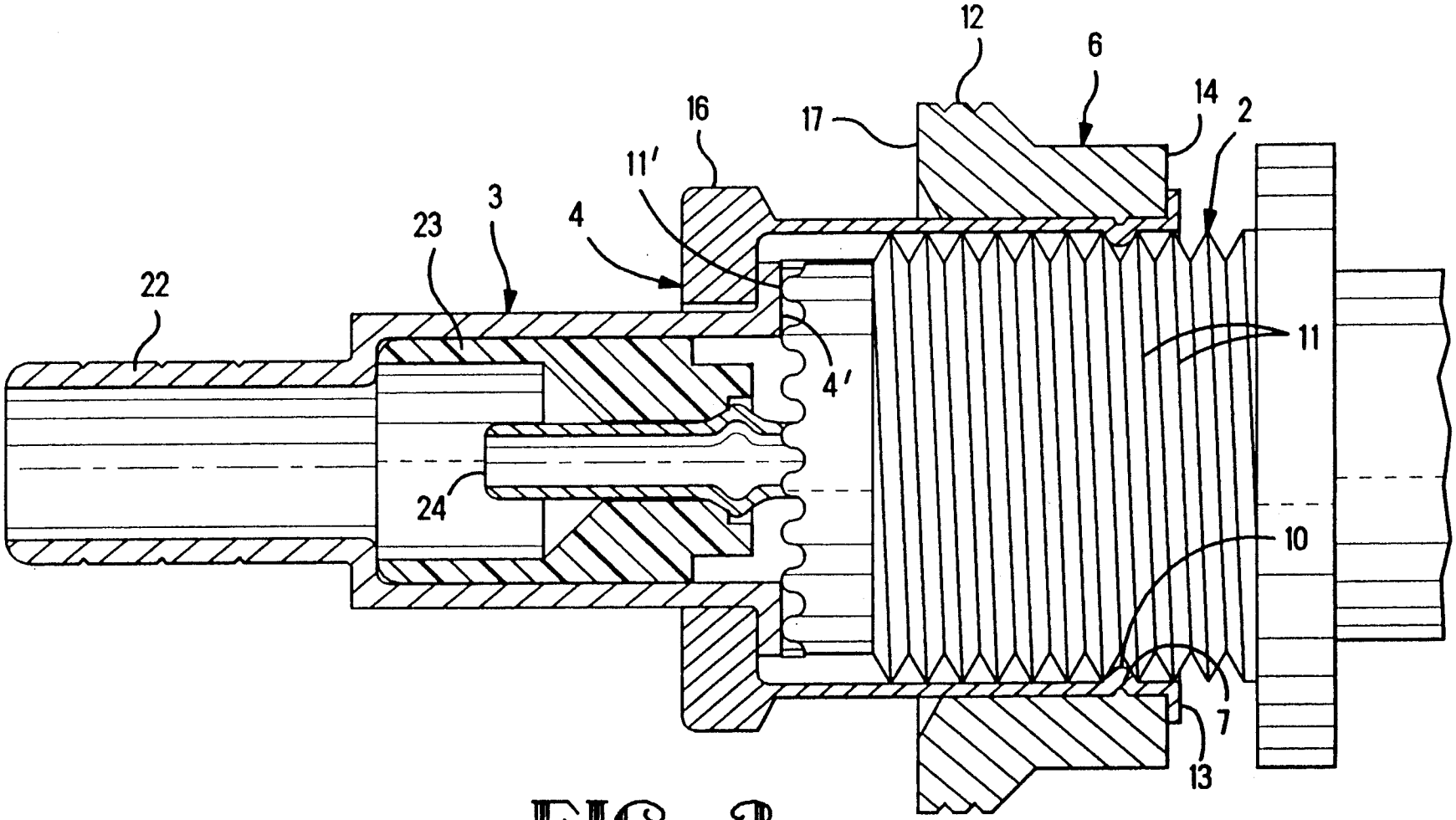
FIG. 3 is a view similar to FIG. 2, of the connector shown in FIG. 2 connected to a threaded jack.
Figure 5:
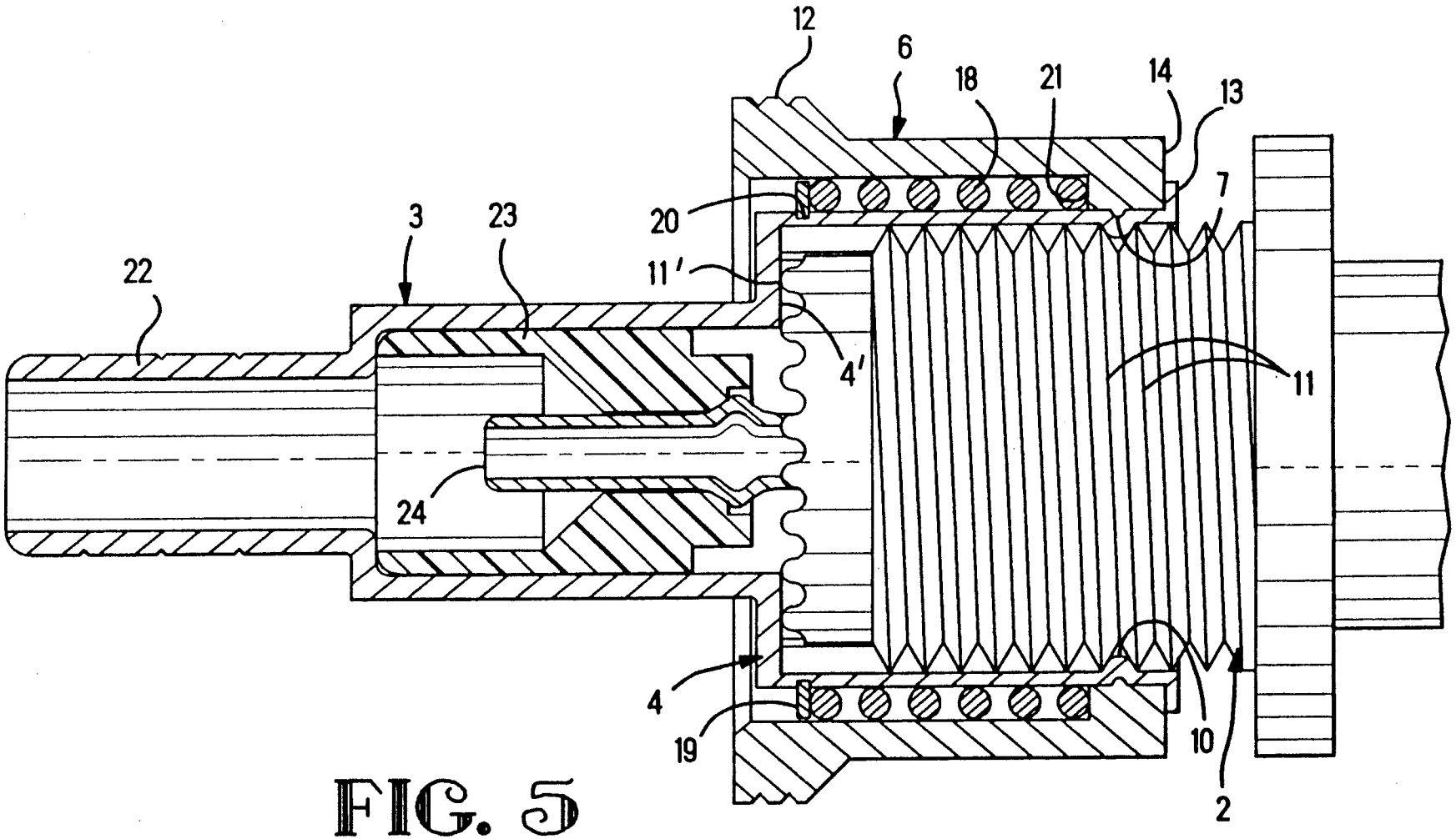
FIG. 5 is a view similar to FIG. 4 illustrating the plug connected to a jack.

The plug 1 comprises, a plug portion 3 for termination of a coaxial cable, not shown, a coupling ring 4 over the plug portion 3 having an open front end 5 larger than an external diameter of the threaded jack 2, FIGS. 3 and 5, received in the open front end 5, and a grip member 6 moveable over the coupling ring 4 to prevent expansion of the coupling ring 4 once the coupling ring 4 encircles the jack 2. An inward facing catch member 7 of the grip member 6 snaps into a catch s provided by a recess in the coupling ring 4 at the open front end 5 of the coupling ring 4, thereby to provide a positive feel that a secure connection has been made.

The coupling ring 4 is constructed for being enlargeable radially. The open front end 5 of the coupling ring 4 is slotted by multiple slots 9 intersecting the front end 5 and extending through the thickness of the coupling ring 4. The slots 9 extend axially, meaning perpendicular to the radial direction of the coupling ring 4.

The coupling ring 4 is constructed for locking against the external diameter of the jack 2. An inward facing projection 10 on the front end 5 of the coupling ring 4 is between the slots 9. The projection 10 faces radially inward and registers against external threads 11 of the jack 2. Movement of the coupling ring 4 forwardly over the jack 2 with a push-on motion will cause the projection 10 to traverse forwardly and over the threads 11 in a ratchet type movement following the rise and fall of the threads. The coupling ring 4 will move forwardly until a front end 11' of the jack 2 engages an interior transverse shoulder 4' of the coupling ring 4. The front end 5 of the coupling ring 4 will resiliently expand and contract as the projection 10 traverses over the rise and fall of the threads 11. The projection 10 locks against the external diameter of the jack 2 upon the coupling ring 4 being held from expansion radially by the grip member 6 encircling the front end 5.

An interior diameter of the grip member 6 encircles the coupling ring 4. When the grip member 6 is moved forwardly with a push-on motion to encircle the slotted front end 5, the slotted front end will be held by the grip member from expanding radially. The projection 10 will be forced inwardly radially against the threads 11, and will be held against the threads 11 by the grip member 6 encircling the front end 5. The projection 10 is bluntly pointed so as to register in and lockingly engage in one of the recessed threads 11 of the jack 2.

Figure 1:
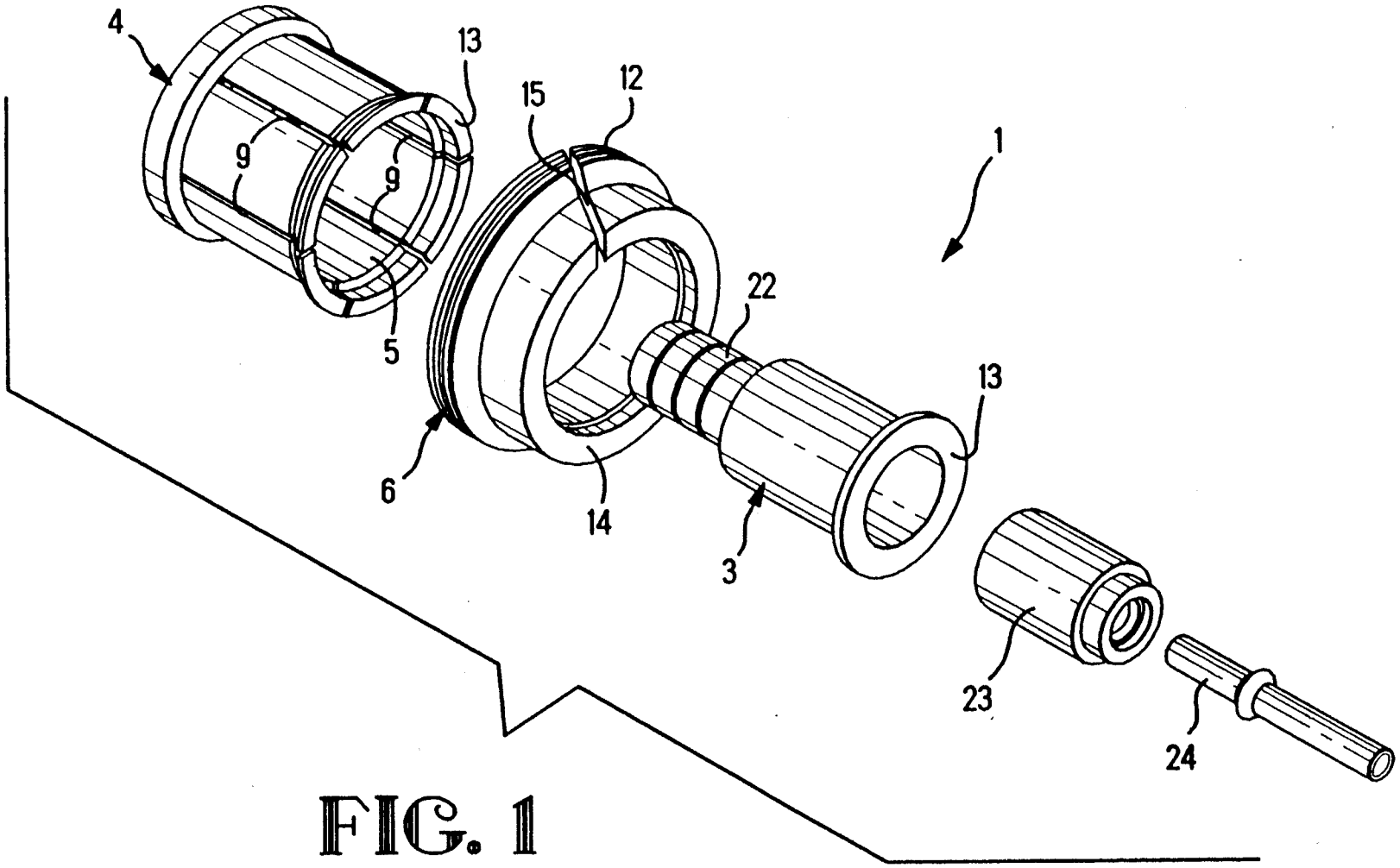
FIG. 1 is a perspective view of an electrical plug type connector for connection to a jack, with component parts separated from one another.
Figure 2:
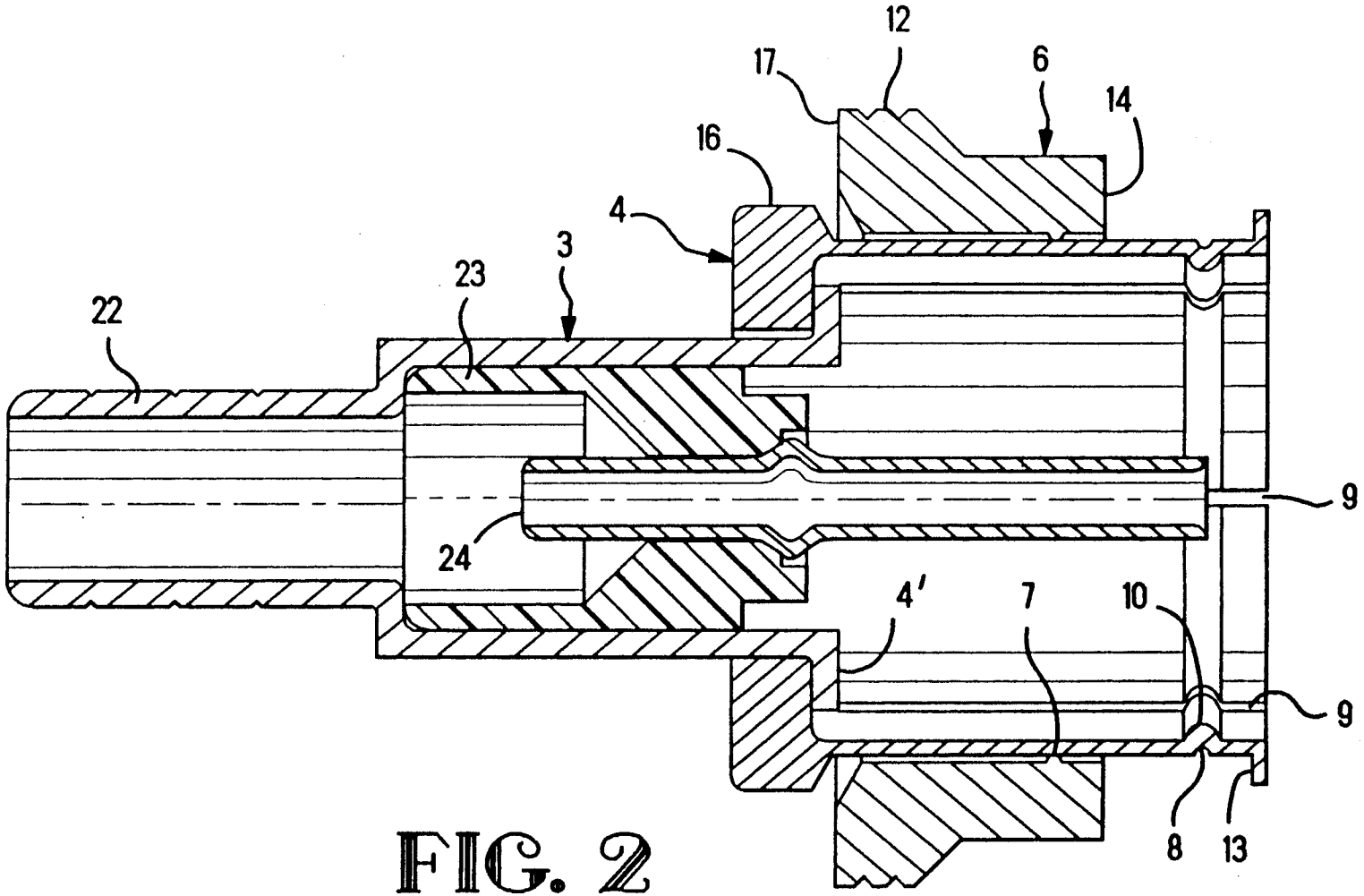
FIG. 2 is an elevation view in section of the connector shown in FIG. 1.

The grip ring 6 includes an enlarged exterior portion 12 with an enlarged diameter to facilitate being grasped. The coupling ring 4 is provided with an exterior, radially projecting lip 13 to limit forward movement of the grip ring 6 by providing a stop overlapping a front end 14 of the grip member 6. The grip ring is split by a seam 15, FIG. 1, to permit resilient enlargement of the diameter for passing over the lip 13 during assembly of the grip member over the coupling ring 4. Rearward movement of the grip member is limited by an enlarged diameter, external projection 16, FIGS. 1-3, on the coupling ring 4 overlapping a rear end 17 of the grip member 6.

Figure 4:
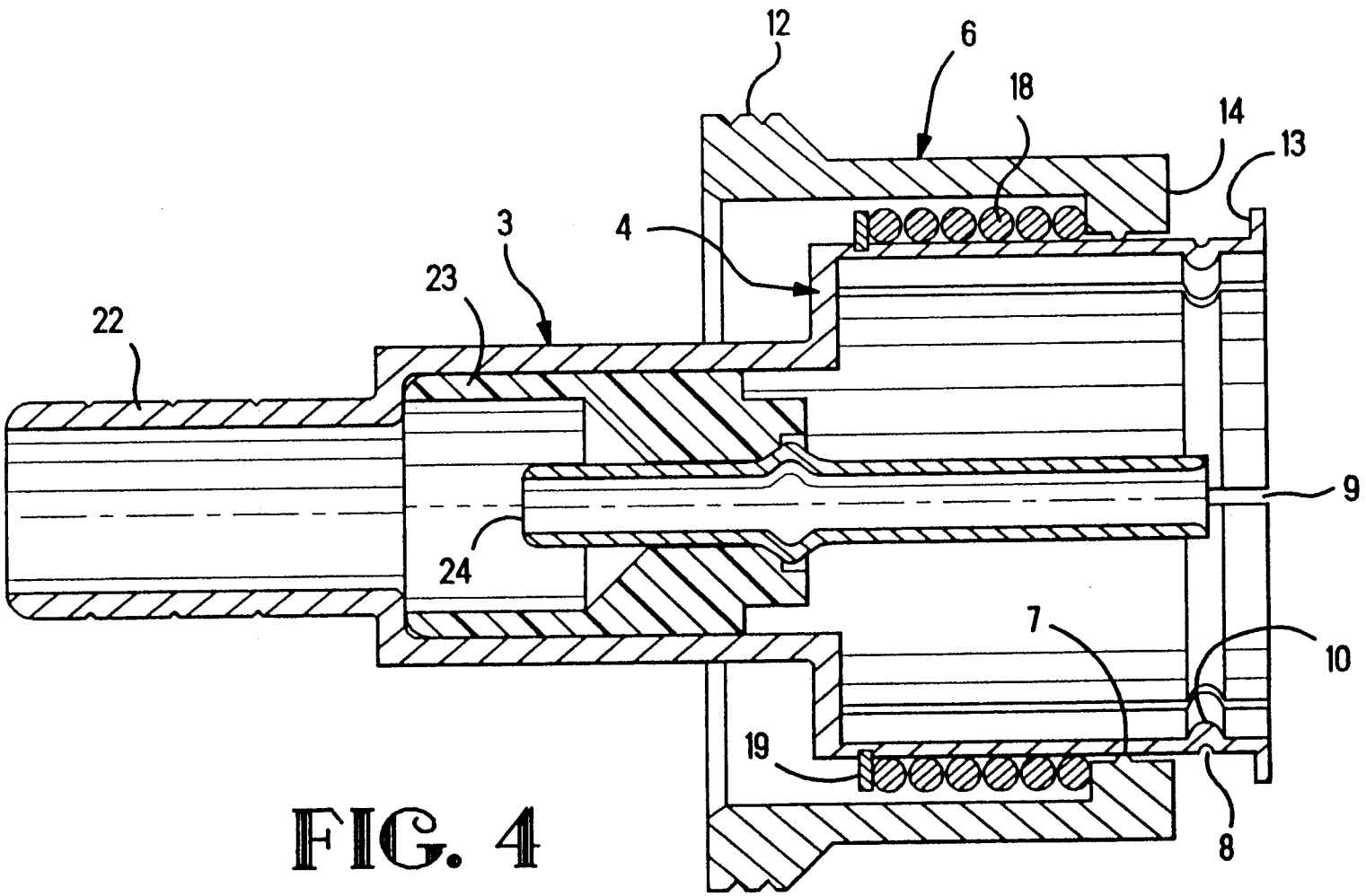
FIG. 4 is an elevation view in section of a plug type electrical connector for connection to a jack.

In FIGS. 4 and 5, such movement is limited by a coil spring 18 against a clip 19.

The electrical plug 1 according to the embodiment of FIGS. 4 and 5, further comprises, the coil spring 18 encircling the coupling ring 4 and biasing the grip member 6 in a forward direction. A rear end of the coil spring 18 is against an encircling clip 19 that is snapped into place in a circumferential groove 20 encircling the coupling ring 4. The spring 18 is encircled by the grip member 6. A front end of the spring 18 engages a rear facing shoulder 21 of the grip member 6. The grip member 6 is moveable forwardly against the stop provided by the lip 13.

The plug portion 3 comprises, a conductive shell 22 for encircling a coaxial cable, not shown, a dielectric member 23 concentrically encircled by the shell 22, and a conductive central contact 24 for connection to a central conductor of a coaxial cable, not shown. Further details of the plug portion 3 and the manner in which the plug portion 3 is connected to a cable is disclosed in U.S. Pat. No. 4,070,751.

According to the invention, an electrical plug is adapted for connection to a threaded jack connector with a positive feel that a secure connection has been made.

Further according to the invention, an electrical plug is adapted for connection to a threaded jack connector with a push on motion instead of a turning motion.

What is claimed is:

1. An electrical plug for connection to a jack, comprising:

a plug portion for termination of a coaxial cable, a coupling ring encircling the plug portion and adapted to encircle a threaded jack, at least a portion of the coupling ring being enlargeable radially, a projection on the coupling ring facing inwardly, the projection biasing the coupling ring radially when riding over threads of the threaded jack, an external catch on the coupling ring, a grip member encircling the coupling ring and being moveable forwardly relative to the coupling ring to a position encircling the enlargeable portion of the coupling ring, an inward facing catch member on the grip member in registration with said external catch, whereby said grip member encircles the enlargeable portion of the coupling ring to limit the radial expansion thereof.

2. An electrical plug according to claim 1, comprising: the coupling ring being constructed with slots through a resiliently bendable portion of the coupling ring.

3. An electrical plug according to claim 1, comprising: the grip member is a split ring.

4. An electrical plug according to claim 1, comprising: the projection being pointed and adapted to engage in a threaded portion of a threaded jack.

5. An electrical plug according to claim 1, comprising: a coil spring encircling the coupling ring and biasing the grip member in a forward direction.

6. An electrical plug as recited in claim 1, wherein the coupling ring is enlarged at a rear end and overlaps a rear end of the grip member.

7. An electrical plug as recited in claim 1, wherein the coupling ring has slots intersecting a front end, and the projection is on the front end between the slots.

8. An electrical plug for connection to a threaded jack, comprises:

a center contact connected to a center conductor of an electrical cable, a conductive outer shell concentrically encircling the center contact, a dielectric in a concentric space between the center conductor and the shell, a coupling ring for connection to a threaded coupling, the coupling ring having a radially inward projection on a radially deformable front end, and a grip member moveable over the coupling ring having an inward detent facing the coupling ring, the grip member in a retracted position engaging the detent in a recess of the coupling ring, and the grip being moveable along the coupling ring toward a position forward of the retracted position whereat the detent snaps over said front end of the coupling ring and the grip member radially bends the open end to move the detent along and against a threaded portion of the jack.

9. An electrical plug as recited in claim 8, wherein the detent is locked against the threaded portion.

10. An electrical plug as recited in claim 8, wherein the coupling ring has slots intersecting said front end, and the projection is on the front end between the slots.

11. An electrical plug as recited in claim 8, wherein said front end of the coupling ring includes an opening at the front end where said opening is larger than the external diameter of the threaded coupling ring, whereby the opening is reduced in diameter by the grip member as it is moved over the coupling ring to encircle the front end.

12. An electrical plug as recited in claim 8, further including a coil spring between the coupling ring and the grip biasing the grip forwardly.

* * * * *